US005536103A

United States Patent [19]

Sawada

[11] Patent Number: 5,536,103

[45] Date of Patent: Jul. 16, 1996

[54] CONNECTOR HAVING CORE AND INSERT-MOLDED TERMINAL

[75] Inventor: Hisashi Sawada, Yokkaichi City, Japan

[73] Assignee: Sumitomo Wiring Systems, Ltd., Yokkaichi, Japan

[21] Appl. No.: 380,335

[22] Filed: Jan. 30, 1995

Related U.S. Application Data

[63] Continuation-in-part of Ser. No. 111,540, Aug. 25, 1993, abandoned.

[30] Foreign Application Priority Data

Oct. 7, 1992 [JP] Japan ..... 4-268551

[51] Int. Cl.[6] ..... B25G 3/18; H01R 13/52

[52] U.S. Cl. ..... 403/326; 403/367; 403/374; 439/274; 439/744

[58] Field of Search ..... 403/315, 316, 403/374, 367, 375, 326; 439/744, 745, 746, 271, 274, 275

[56] References Cited

U.S. PATENT DOCUMENTS

| | | | |
|---|---|---|---|
| 2,785,384 | 3/1957 | Wickesser | 439/474 |
| 3,124,407 | 3/1964 | Lazar et al. | 439/745 |
| 3,874,761 | 4/1975 | Stauffer . | |
| 3,937,545 | 2/1976 | Cairns et al. . | |
| 4,214,802 | 7/1980 | Otani et al. . | |
| 4,355,855 | 10/1982 | Rebikoff | 439/275 X |
| 4,391,480 | 7/1983 | Mina . | |
| 4,395,085 | 7/1983 | Inoue . | |
| 4,560,219 | 12/1985 | Chapelot . | |
| 4,618,198 | 10/1986 | Dale et al. . | |
| 4,698,027 | 10/1987 | Vandame | 439/271 |
| 4,708,662 | 11/1987 | Klein . | |
| 4,894,017 | 1/1990 | Stein et al. | 439/78 |
| 5,306,195 | 4/1994 | Hayashi . | |
| 5,351,973 | 10/1994 | Taniuchi et al. . | |

FOREIGN PATENT DOCUMENTS

| | | |
|---|---|---|
| 2415375 | 8/1979 | France . |
| 64-7777 | 1/1989 | Japan . |
| 2130026 | 5/1980 | United Kingdom . |
| 2077056 | 12/1981 | United Kingdom . |

OTHER PUBLICATIONS

English language abstract of Japanese Utility Model Laid--Open Publication No. 64–7777.

*Primary Examiner*—Hoang Nguyen
*Attorney, Agent, or Firm*—Greenblum & Bernstein

[57] ABSTRACT

A connector includes a housing having an accommodating chamber formed in a connector-engaging direction and a first locking element formed in the accommodating chamber. A core is made of resin and accommodates an insert-molded terminal, and includes a second locking element which engages the first locking element in the accommodating chamber. The core is held in the accommodating chamber due to the engagement between the first locking element and the second locking element. A locking wall projecting in the accommodating chamber locks an end of the core.

5 Claims, 9 Drawing Sheets

CONNECTOR HAVING CORE AND INSERT-MOLDED TERMINAL

This application is a continuation of application Ser. No. 08/111,540, filed Aug. 25, 1993, now abandoned.

BACKGROUND OF THE INVENTION

1. Field of the Invention

The present invention relates to a connector and more particularly to a connector, the housing of which holds a core made of resin and accommodating an insert-molded terminal so as to prevent the terminal from being shaken and removed from the housing and in addition, reduce the length of the housing in a terminal-inserting direction.

2. Description of the Related Arts

Art example of a conventional connector of this kind disclosed in Japanese Laid-Open Utility Model Publication No. 64-7777 is described below with reference to FIG. 24. A lance 3 comprising an elastic arm 3*a* and a locking projection 3*b* formed at the leading end of the elastic arm 3*a* is provided in an accommodating chamber 2 of a housing 1. The lance 3 locks a terminal 4 in the accommodating chamber 2.

In the above-described connector, when the terminal 4 is inserted into the accommodating chamber 2 from the rear side thereof as shown by an arrow (A) of FIG. 24, the elastic arm 3*a* is elastically flexed by the terminal 4. When the terminal 4 has been moved further into the accommodating chamber 2, the locking projection 3*b* of the lance 3 is engaged by a locking opening 4*a* of the terminal 4 as shown by an arrow (C) of FIG. 24. In this manner, terminal 4 is held in the accommodating chamber 2.

In the construction in which the terminal 4 is locked by the elastic lance 3, there is a possibility that the terminal 4 is shaken or removed from the accommodating chamber 2 when an external force such as tensile force is applied to an electric wire connected with the terminal 4.

It is necessary for the elastic arm 3*a* to have a considerable length (L) to allow the lance 3 to be elastic. As a result, the housing 1 is necessarily long in a terminal-inserting direction.

SUMMARY OF THE INVENTION

It is an object of the present invention to provide a connector which prevents a terminal held in a housing from being shaken or removed therefrom.

It is another object of the present invention to provide a connector in which the length of the housing is short in a terminal-inserting direction.

In accomplishing these and other objects, there is provided a connector comprising: a housing having an accommodating chamber formed in a connector-engaging direction and first locking means formed in the accommodating chamber; and a core, made of resin and accommodating an insert-molded terminal, comprising second locking means which engages the first locking means of the accommodating chamber. The core is held in the accommodating chamber due to the engagement between the first locking means and the second locking means.

A locking wall projecting in the accommodating chamber locks an end of the core inserted into the accommodating chamber in a predetermined direction.

The first locking means consists of a locking projection formed on an inner peripheral surface of the accommodating chamber. The second locking means consists of a locking groove formed on a peripheral surface of the core.

According to the above-described construction, the locking projection, namely, the first locking means is formed in the accommodating chamber formed in the connector-engaging direction of the housing. The locking groove, namely, the second locking means is formed on the peripheral surface of the core, made of resin, accommodating an insert-molded terminal. The locking groove engages the locking projection of the accommodating chamber. In this manner, the core is held in the accommodating chamber. The locking wall formed in the accommodating chamber locks the end of the core inserted into the accommodating chamber in the predetermined direction. Accordingly, when an external force such as tensile force is applied to an electric wire connected with the terminal, the terminal can be prevented from being shaken and removed from the housing.

In addition, the core accommodating the insert-molded terminal is held in the housing due to the engagement between the locking projection of the housing and the locking groove of the core. Therefore, it is unnecessary to form a lance in the housing. As a result, it is unnecessary to elongate the housing in the terminal inserting direction thereof, unlike the conventional connector requiring the lance which necessitates the elongation of the housing.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
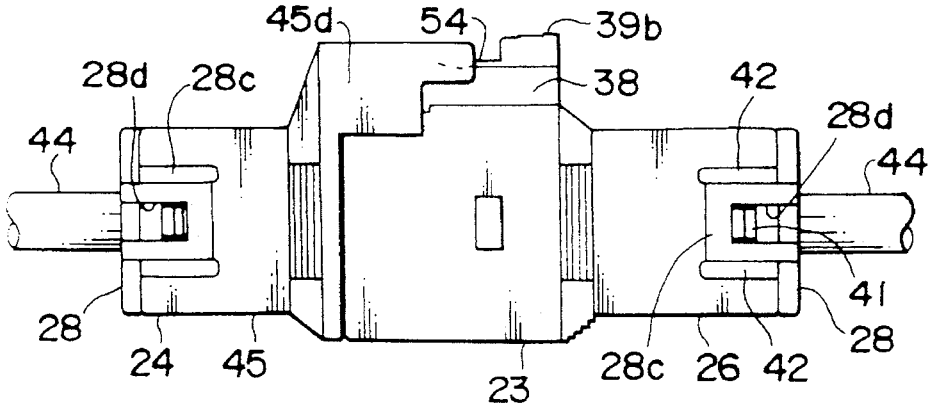
FIG. 1 is a front view showing a connector according to an embodiment of the present invention.
Figure 2:
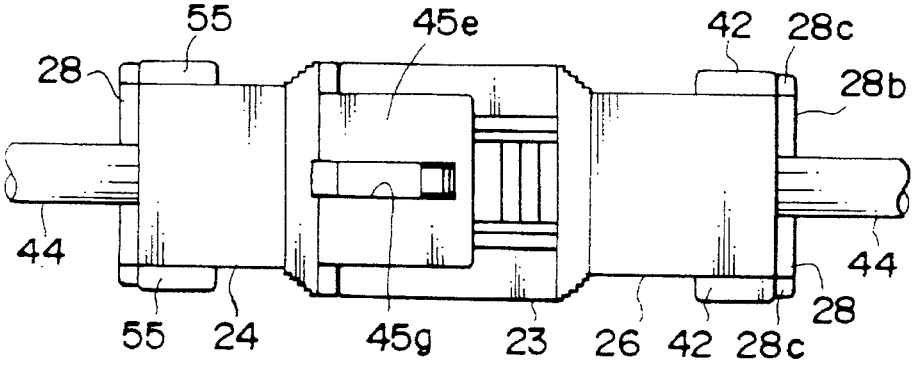
FIG. 2 is a plan view showing the connector of FIG. 1.

Before the description of the present invention proceeds, it is to be noted that like parts are designated by like reference numerals throughout the accompanying drawings.

A connector according to an embodiment of the present invention is described below with reference to FIGS. 1 through 23.

A connector shown in FIGS. 1 through 6 comprises a female connector 23 and a male connector 24 connected to each other so as to connect a female terminal 21 of the female connector 23 and a male terminal 22 of the male connector 24 to each other.

In the female connector 23, a female core 27 made of resin is inserted into a female housing 26 made of resin. The female core 27 accommodates the insert-molded female terminal 21. A closing member 28 closes one end of the female housing 26. The closing member 28 is described later.

As shown in detail in FIGS. 6 through 10, the female housing 26, sectionally rectangular and cylindrical, comprises a female terminal accommodating chamber 29 and a rubber ring accommodating chamber 30 continuous with the female terminal accommodating chamber 29. The chambers 29 and 30 are formed from the front end surface 26*a*, of the female housing 26, at which the female connector 23 engages the male connector 24 toward the rear end surface 26b of the female housing 26. The female terminal accommodating chamber 29 and the rubber ring accommodating chamber 30 are sectionally circular. A pair of locking walls 31 and 31 is formed at the connecting portion between the female terminal accommodating chamber 29 and the rubber ring accommodating chamber 30.

A pair of locking projections 32 and 32 opposed to each other is formed in the rear side of an inner peripheral surface 29*a* of the female terminal accommodating chamber 29. The locking projections 32 and 32 constituting a first locking means engages a locking groove 27*e* of a core 27 which will be described later.

The locking projections 32 comprises an inclined portion 32*a* inclining with respect to the inner peripheral surface 29*a;* a flat portion 32*b* almost parallel with the inner peripheral surface 29*a;* and an engaging portion 32*c* almost perpendicular to the inner peripheral surface 29*a*. These members 32*a*, 32*b*, and 32*c* are continuous with each other and formed in the direction from the front side (X).

Figure 9:
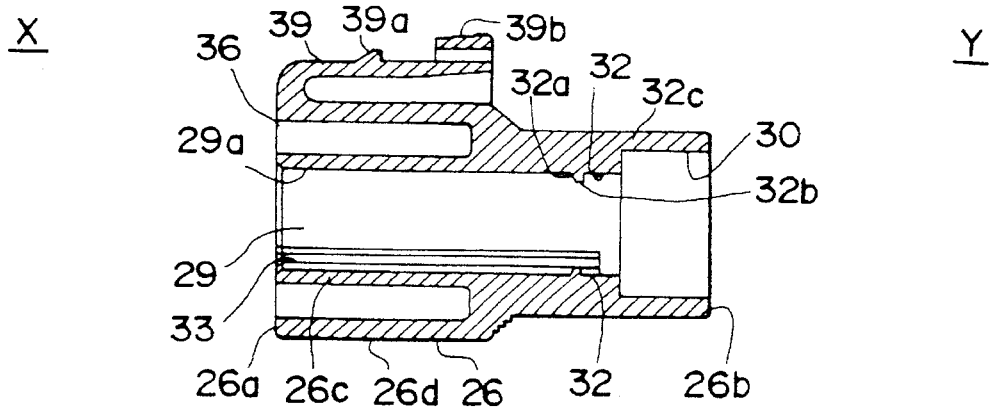
FIG. 9 is a sectional view, showing the housing of the female connector of FIG. 6, taken along a line IX—IX of FIG. 8B.
Figure 10:
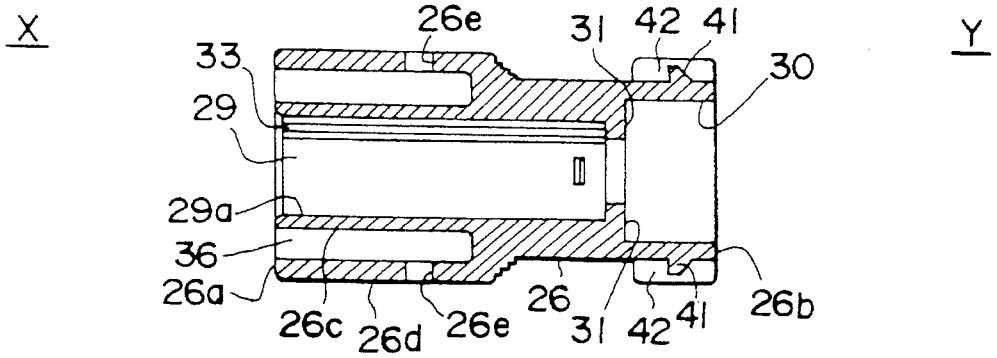
FIG. 10 is a sectional view, showing the housing of the female connector of FIG. 6, taken along a line X—X of FIG. 8B.

Referring to FIGS. 8 through 10, a pair of core guide grooves 33 and 33 opposed to each other is formed on the inner peripheral surface 29*a* of the female terminal accommodating chamber 29. The core guide grooves 33 and 33 are sectionally rectangular and extend along the entire female terminal accommodating chamber 29 in the longitudinal direction thereof.

Figure 4:
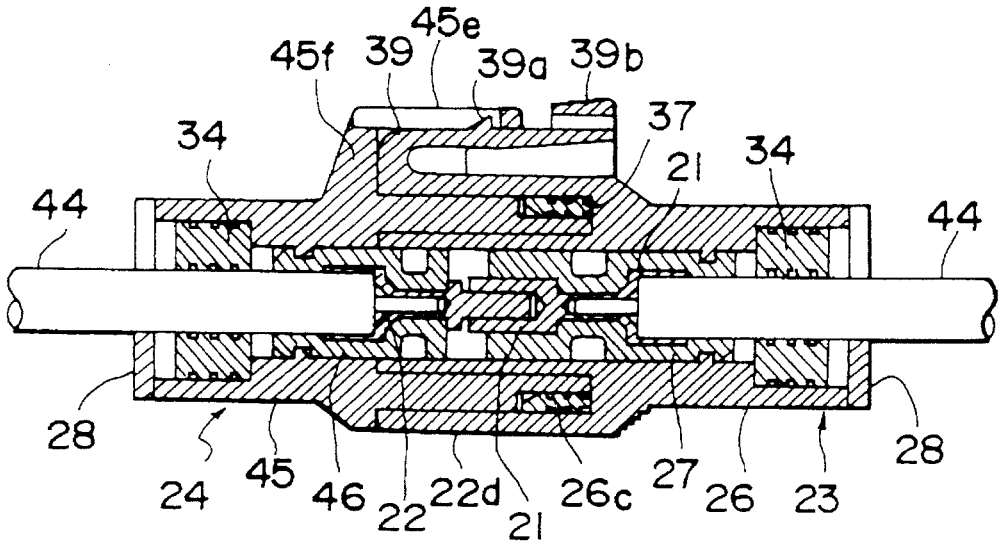
FIG. 4 is a sectional view, showing the connector of FIG. 1, taken along a line IV—IV of FIG. 3B.
Figure 5:
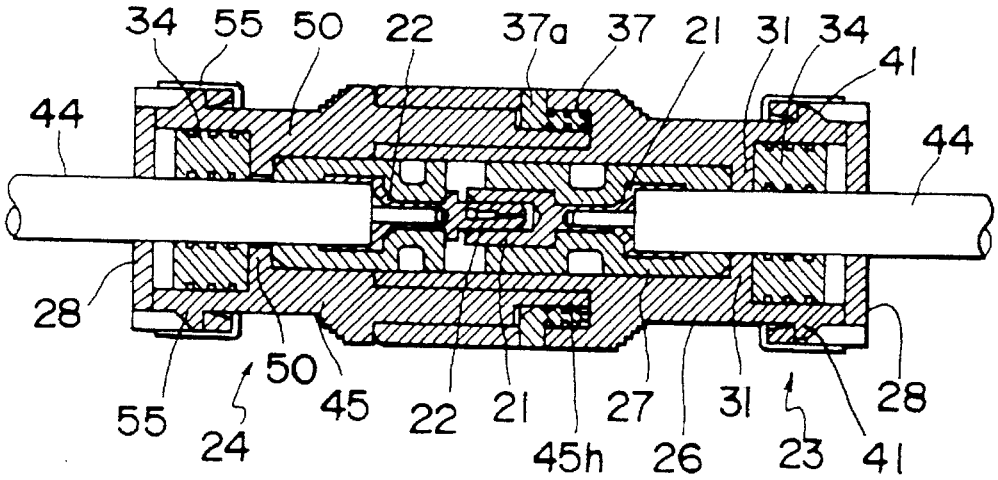
FIG. 5 is a sectional view, showing the connector of FIG. 1, taken along a line V—V of FIG. 3B.
Figure 6:
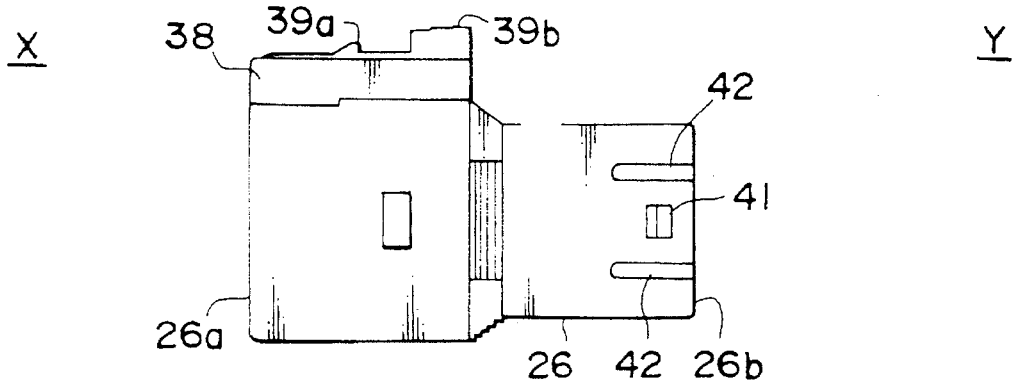
FIG. 6 is a front view showing a housing of a female connector of the connector of FIG. 1.
Figure 7:
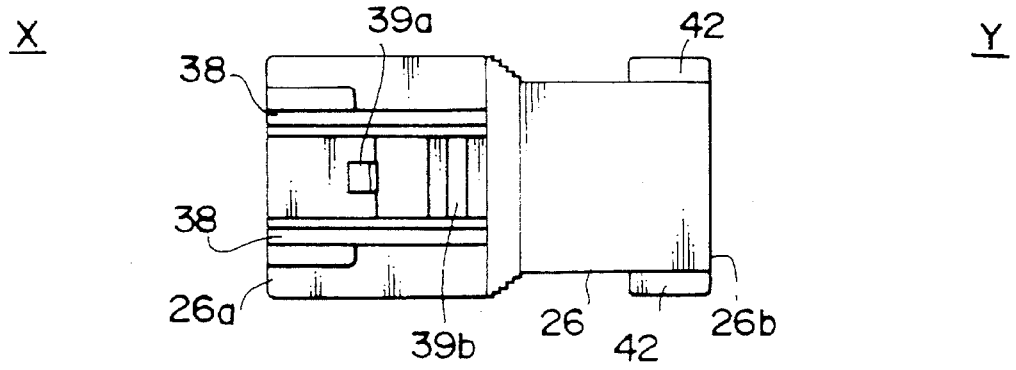
FIG. 7 is a plan view showing the housing of the female connector of FIG. 6.
Figure 8A:
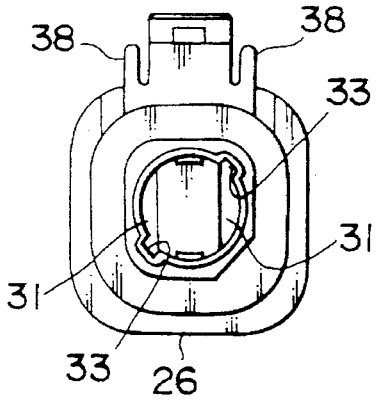
FIG. 8A is a left side view showing the housing of the female connector of FIG. 6.
Figure 8B:
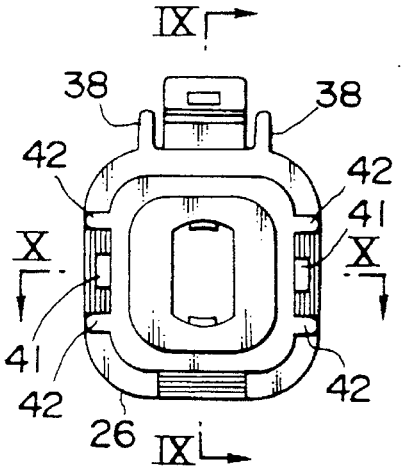
FIG. 8B is a right side view showing the housing of the female connector of FIG. 6.

Referring to FIGS. 4 and 5, the sectional area of the rubber ring accommodating chamber 30 is greater than that of the female terminal accommodating chamber 29 so that an annular second rubber ring 34 is inserted into the rubber ring accommodating chamber 30.

As shown in FIGS. 9 and 10, the peripheral wall of the female housing 26 has a double construction in the front side (X) thereof so as to form a gap 36 between an inner wall of the female housing 26 and an outer wall 26*d* thereof. The male housing 45 of the male connector 24 is inserted into the gap 36.

A pair of cut-out openings 26*e* and 26*e* opposed to each other is formed in the rear side (Y) of the outer wall 26*d*. A pair of projections 37*a* and 37*a* (see FIG. 5) formed on the peripheral surface of an annular second rubber ring 37 (see FIGS. 4 and 5) is locked by each of the cut-out openings 26*e* and 26*e*, thus holding the second rubber ring 37 in the gap 36.

Rectangular guide plates 38 and 38 (see FIGS. 6, 7, 8A and 8B) opposed to each other and integral with the female housing 26 is formed on an upper portion of the outer wall 26*d* of the female housing 26. The guide plates 38 and 38 are disposed in the front side (X) of the female housing 26. The front end portion of the outer wall 26*d* is folded back toward the rear side (Y) to form a locking elastic arm 39 (see FIGS. 4, 6, 7, and 9) between the guide plates 38 and 38.

The elastic arm 39 is elastically flexed, with the front end portion of the outer wall 26*d* serving as the fulcrum of the flexure. A locking projection 39*a* (see FIGS. 6, 7, and 9) which engages a locking opening 45*g* (see FIGS. 2, 16, and 18) formed on the male housing 45 of the male connector 24 is formed in the vicinity of the center of the elastic arm 39 in the longitudinal direction thereof, and a pressing portion 39*b* (see FIGS. 6, 7, and 9) is formed in the rear end of the elastic arm 39. The locking opening 45*g* will be described later.

A pair of locking projections 41 and 41 (FIGS. 5, 6, and 8) which engages each of a pair of locking openings 28*d* and 28*d* of the closing member 28 is formed in the vicinity of the rear end of the female housing 26. Each projection 41 is interposed between a pair of rectangular guide plates 42 and 42.

As shown in detail in FIGS. 11 through 14, the female core 27 made of insulating resin accommodates the insert-molded female terminal 21.

The female terminal 21 made of a conductive material such as copper comprises a cylindrical portion 21*a* (see FIG. 14) into which a leading end 22*c* (see FIG. 20) of the male terminal 22 is inserted. The cylindrical portion 21*a* is disposed in the front side (X) of the female terminal 21. The female terminal 21 further comprises a core wire crimping portion 21*b* of a small diameter and a coating crimping portion 21*c* of a large diameter. The core wire crimping portion 21*b* is continuous with the cylindrical portion 21*a*. The core wire crimping portion 21*b* crimps a core wire 44*a* of an electric wire 44 while the coating crimping portion 21*c* continuous with the core wire crimping portion 21*b* crimps the coating portion of the electric wire 44.

The female terminal 21 is insert-molded in the female core 27, with the core wire 44*a* and the coating portion 44*b* crimped by the core wire crimping portion 21*b* and the coating crimping portion 21*c*, respectively.

Figure 14:
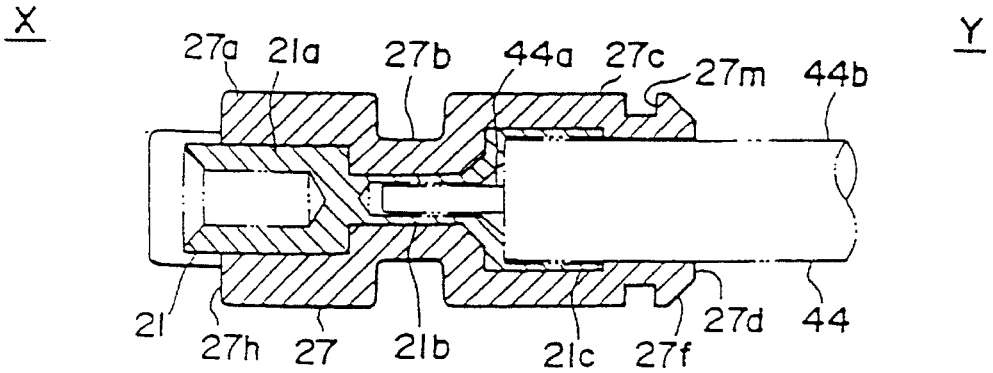
FIG. 14 is a sectional view, showing the core of FIG. 11, taken along a line XIV—XIV of FIG. 13A.
Figure 15:
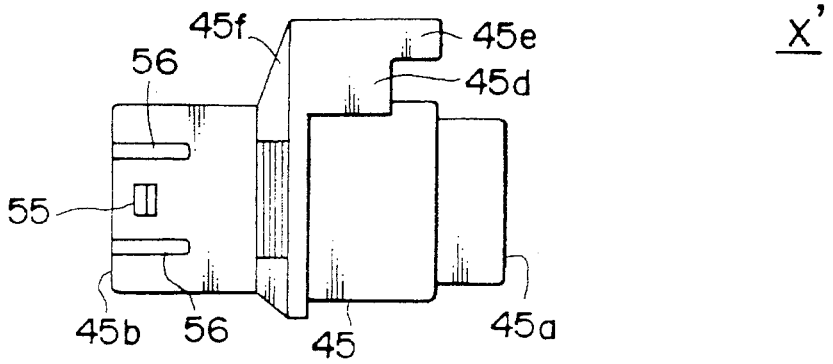
FIG. 15 is a front view showing a housing of a male connector of the connector of FIG. 1.
Figure 16:
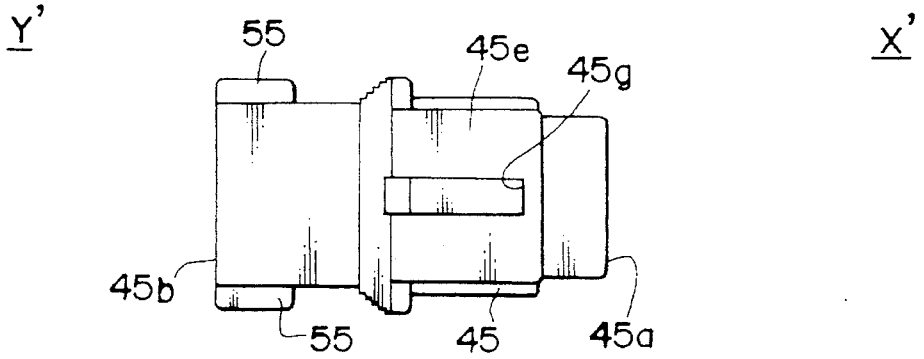
FIG. 16 is a plan view showing the housing of the male connector of FIG. 15.
Figure 17A:
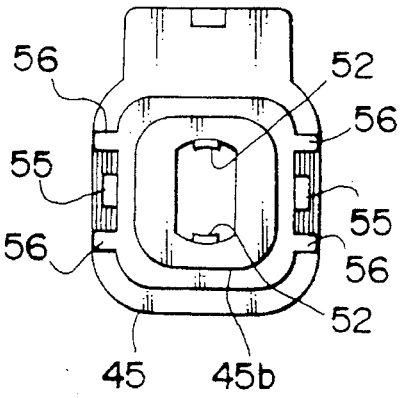
FIG. 17A is a left side view showing the housing of the male connector of FIG. 15.
Figure 17B:
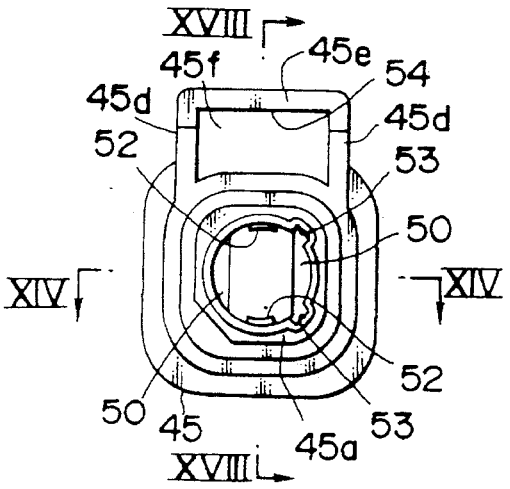
FIG. 17B is a right side view showing the housing of the male connector of FIG. 15.
Figure 18:
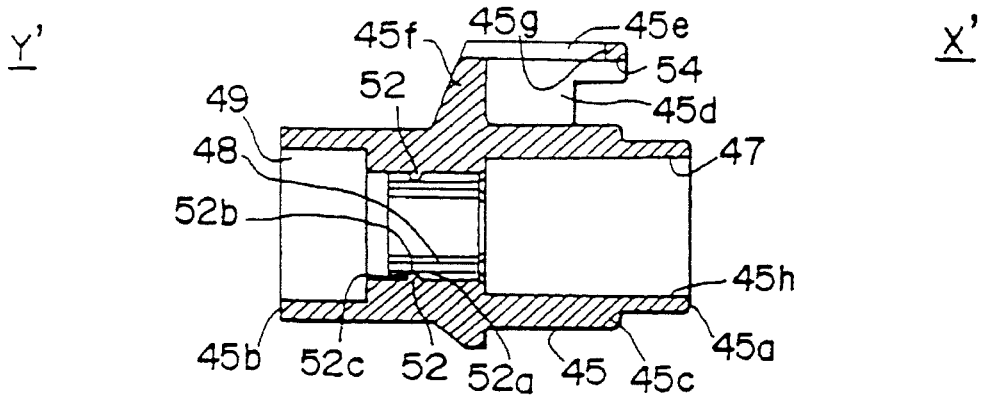
FIG. 18 is a sectional view, showing the housing of the male connector of FIG. 15, taken along a line XVIII—XVIII of FIG. 17B.
Figure 19:
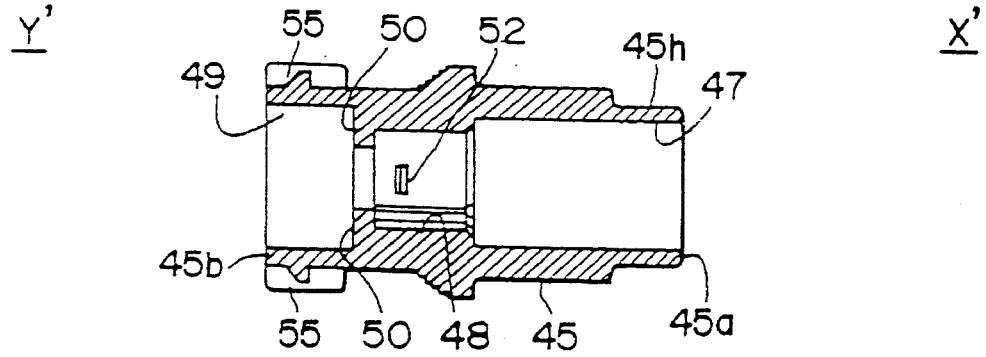
FIG. 19 is a sectional view, showing the housing of the male connector of FIG. 15, taken along a line XIV—XIV of FIG. 17B.
Figure 20:
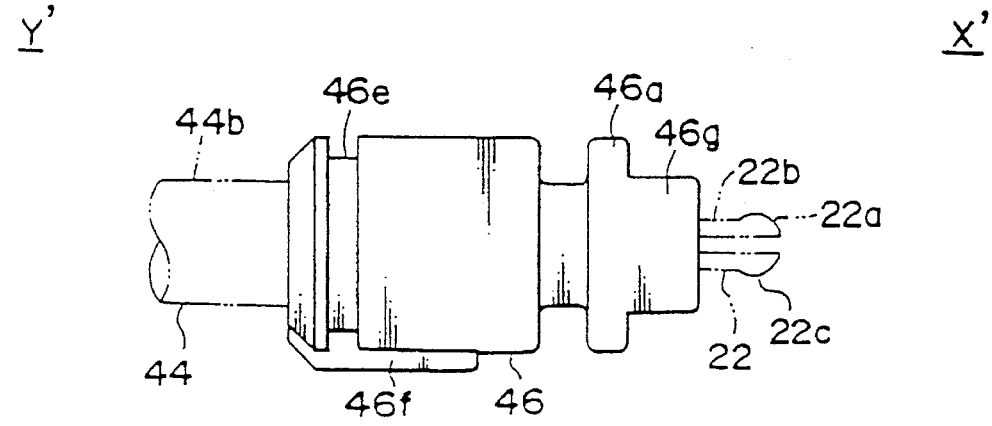
FIG. 20 is a front view showing a male core.
Figure 21:
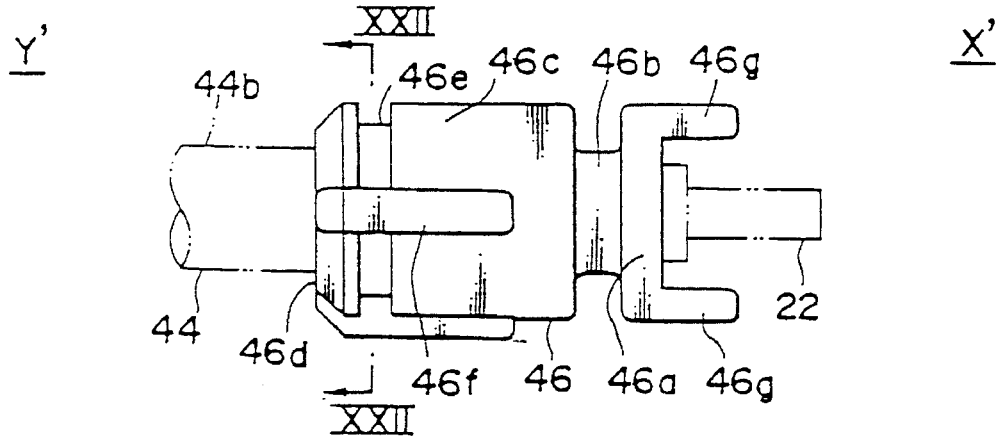
FIG. 21 is a bottom view showing the core of FIG. 20.
Figure 22A:
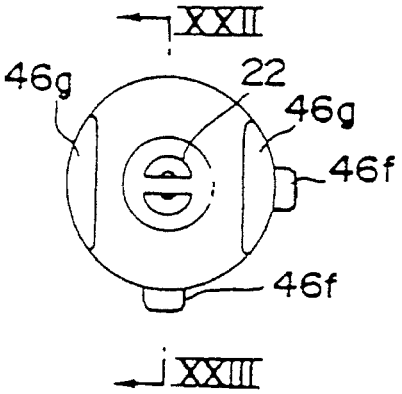
FIGS. 22A and 22B are a right side view showing the core of FIG. 20; and a sectional view, showing the core of FIG. 20, taken along a line XXII—XXII of FIG. 20.
Figure 22B:
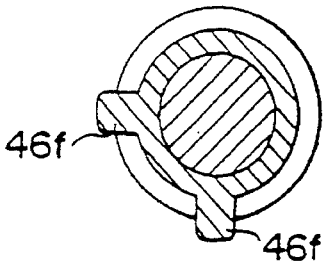
Figure 23:
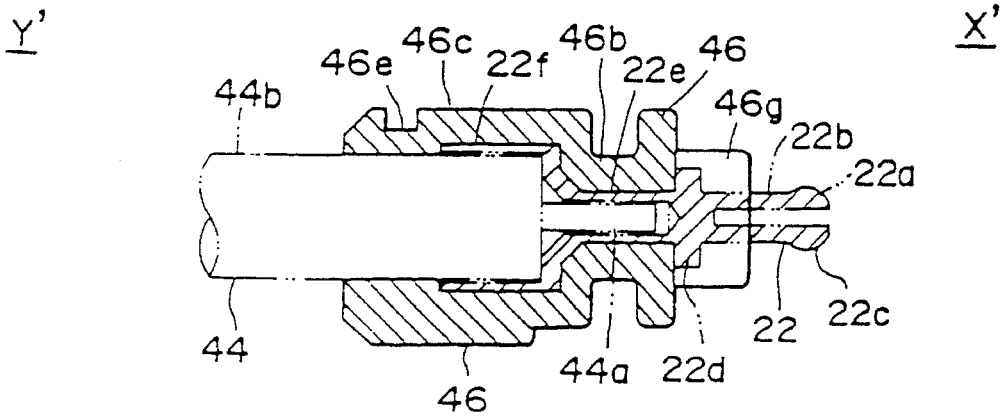
FIG. 23 is a sectional view, showing the core of FIG. 20, taken along a line XXIII—XXIII of FIG. 22.
Figure 24:
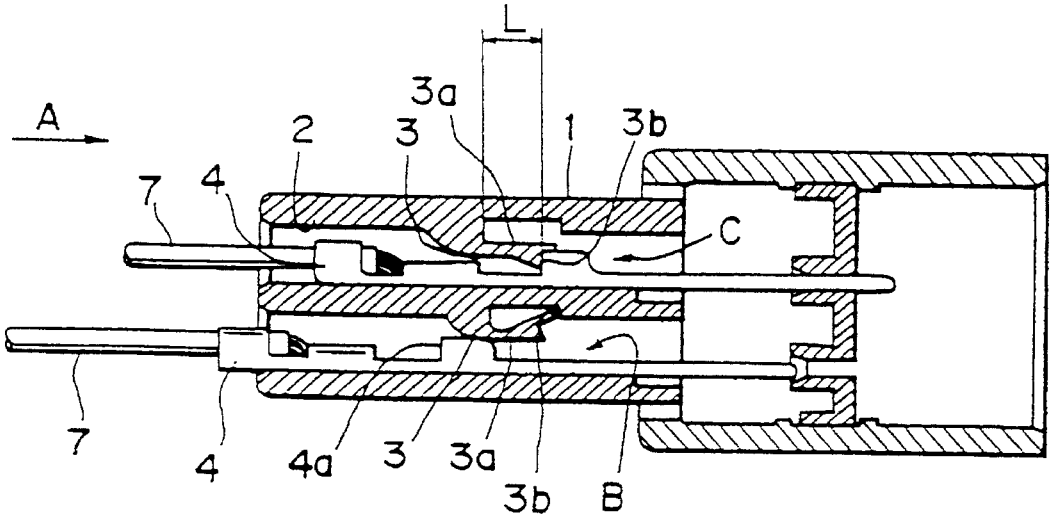
FIG. 24 PRIOR ART
FIG. 24 is a sectional view showing a conventional connector.

Referring to FIG. 14, the cylindrical female core 27 comprises a first large-diameter portion 27*a* accommodating the cylindrical portion 21*a* of the female terminal 21; a small-diameter portion 27*b* accommodating the core wire crimping portion 21*b*; and a second large-diameter portion 27*c* accommodating the coating crimping portion 21*c*. The outer diameter of the first large-diameter portion 27*a* and that of the second large-diameter portion 27*c* are set so that the first large-diameter portion 27*a* and the second large-diameter portion 27*c* are slidable in close contact with the inner peripheral surface 29*a* of the female terminal accommodating chamber 29.

Figure 11:
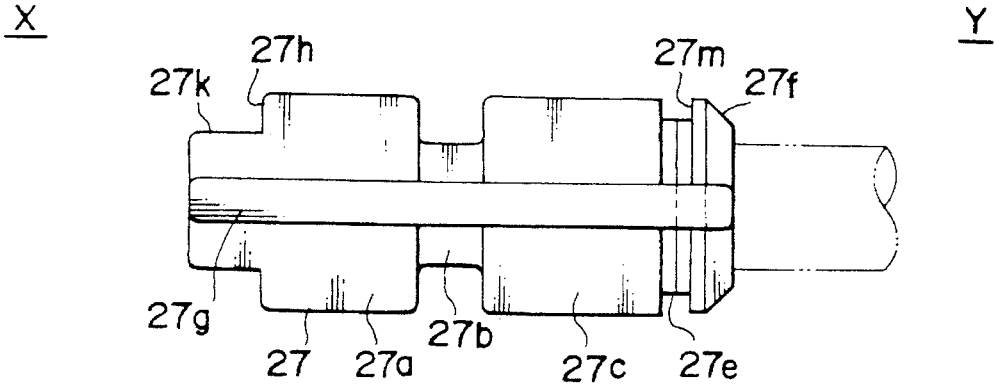
FIG. 11 is a front view showing a female core.
Figure 12:
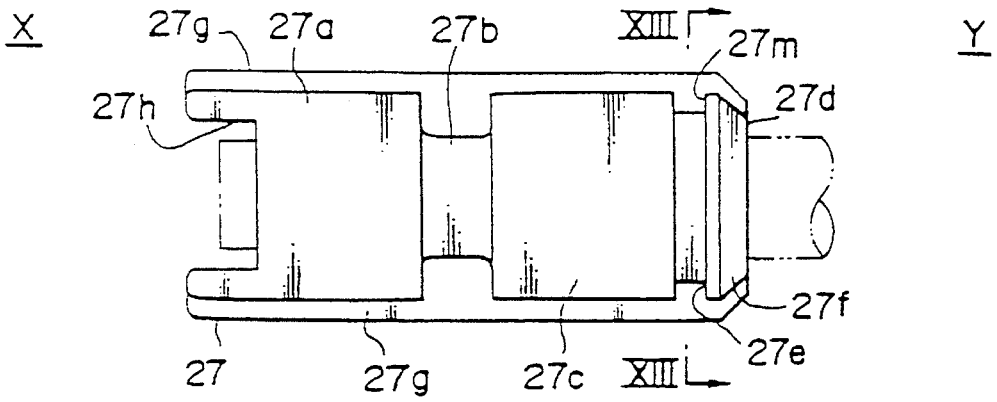
FIG. 12 is a plan view showing the core of FIG. 11.
Figure 13A:
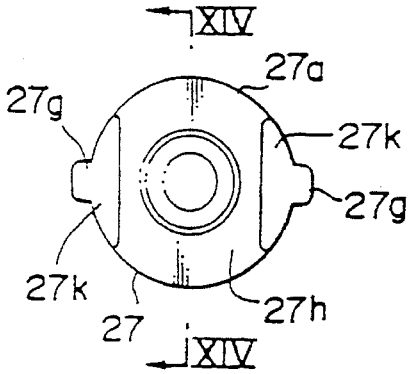
FIGS. 13A and 13B are a right side view showing the core of FIG. 11 and a sectional view, showing the core of FIG. 11, taken along a line XIII—XIII of FIG. 12A.
Figure 13B:
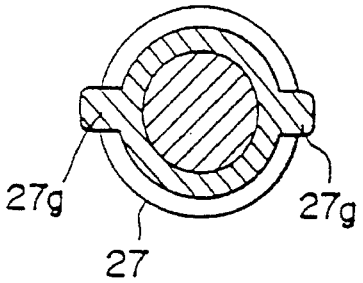

Referring to FIGS. 11 and 12, a locking groove 27*e*, sectionally rectangular, serving as a second locking means is circumferentially formed in the vicinity of the rear end surface 27*d* of the second large-diameter portion 27*c*. The end surface 27*d* is circumferentially chamfered to form an inclined portion 27*f*.

There is formed, on the peripheral surface of the female core 27, a pair of guide plates 27*g* and 27*g* (see FIGS. 11, 12, 13A, and 13B) opposed to each other and extending from the front end surface 27*h* of the female core 27 toward the rear end thereof.

A pair of protecting walls 27*k* and 27*k* (see FIG. 13A) projects from the front end surface 27*h* of the female core 27 in such a manner that the cylindrical portion 21*a* of the female terminal 21 projecting from the front end surface 27*h* is interposed between the protecting walls 27*k* and 27*k*.

Figure 3A:
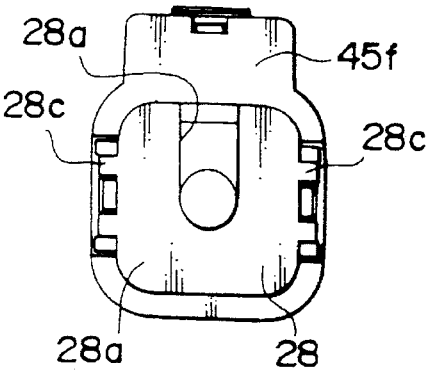
FIG. 3A is a left side view showing the connector of FIG. 1.
Figure 3B:
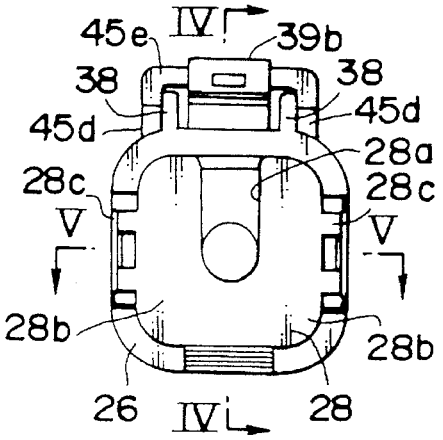
FIG. 3B is a right side view showing the connector of FIG. 1.

Referring to FIGS. 1, 3A, and 3B, the closing member 28 which is approximately rectangular and closes the rubber ring accommodating chamber 30 comprises a plate 28*b* on which a cut-out 28*a* (see FIG. 3A) is formed and a pair of locking arms 28*c* and 28*c* disposed at both sides of the plate 28*b*. A pair of locking openings 28*d* and 28*d* is formed on each of the locking arms 28*c* and 28*c*.

In the female connector 21, the first rubber ring 34 and the second rubber ring 37 are disposed in the rubber ring accommodating chamber 30 of the female housing 26 and the gap 36 thereof, respectively. Then, the female core 27 is inserted into the female terminal accommodating chamber 29 from the front end 26*a*, of the female housing 26, at which the female connector 23 engages the male connector 24, with the guide plates 27*g* and 27*g* of the female core 27 coinciding with each of the guide grooves 33 and 33 of the female housing 26.

As a result, the locking projection 32 of the female housing 26 is inserted into the locking groove 27*e* of the female core 27, and the locking portion 32*c* of the locking projection 32 engages a side wall 27*m* disposed rearward of the locking groove 27*e*. In this manner, the female core 27 is locked in the female housing 26. The rear end surface 27*d* of the female core 27 is locked by the locking walls 31 and 31 of the female housing 26.

Since the female core 27 is guided by the guide groove 33 as described previously, the female core 27 can be smoothly inserted into the female terminal accommodating chamber 29. The inclined surface 27*f* is formed on the rear end surface of the female core 27. Therefore, the inclined portion 32*a* (see FIG. 9) of the locking projection 32 formed in the female terminal accommodating chamber 29 engages the inclined surface 27*f*. In this manner, the locking projection 32 can be smoothly engaged by the locking groove 27*e*.

Thereafter, the electric wire 44 extending from the rear end of the female housing 26 is introduced into the cutout 28*a* (see FIG. 3A), and both sides of the locking arm 28*b* (see FIG. 3B) is inserted between the guide plates 42 and 42 disposed in the rear end of the female housing 26. Then, the locking projection 41 of the female housing 26 is engaged by the locking opening 28*d* (see FIG. 1) of the locking arm 28*c*. In this manner, the closing member 28 is fixed to the rear end of the female housing 26.

In the female connector 23, the female core 27 accommodating the insert-molded female terminal 21 is inserted into the female housing 26 from the connector-engaging side (front side) thereof, and the rear end 27*d* of the female core 27 is locked by the locking wall 31 formed in the female housing 26. Accordingly, when an external force such as tensile force is applied to the electric wire 44, the female terminal 21 can be prevented from being shaken and removed from the female housing 26.

In the female connector 23, the female core 27 is held in the female housing 26 by the engagement between the locking groove 27*e* of the female core 27 and the locking projection 32 formed in the female terminal accommodating chamber 29 of the female housing 26. This way of connecting the female terminal 21 to the female housing 26 eliminates the need for elongating the female connector 23 in the terminal-inserting direction thereof unlike the conventional connector in which the terminal is locked by the lance provided in the housing.

In the male connector 24, a male core 46 (see FIGS. 20 through 23), made of resin, accommodating the insert-molded male terminal 22 is inserted into the male housing 45 made of resin, and one end of the male housing 45 is closed by the closing member 28, similarly to the female connector 23.

As shown in detail in FIGS. 15 through 19, the cylindrical male housing 45 comprises a connector engaging portion 47 (see FIGS. 18 and 19) extending from the front end surface 45*a* of the male housing 45 toward the rear portion thereof; a male terminal accommodating chamber 48; and a rubber ring accommodating chamber 49 disposed in the rear region of the male housing 45. The connector engaging portion 47, the male terminal accommodating chamber 48, and the rubber ring accommodating chamber 49 are continuous with each other and sectionally circular. The diameter of the connector engaging portion 47 is set to be equal to that of the rubber ring accommodating chamber 49 while the diameter of the male terminal accommodating chamber 48 is set to be smaller than those of the connector engaging portion 47 and the rubber ring accommodating chamber 49. A pair of locking walls 50 and 50 (see FIGS. 17B and 19) for locking the male core 46 projects from the connecting portion disposed between the male terminal accommodating chamber 48 and the rubber ring accommodating chamber 49.

A pair of locking projections 52 and 52 (see FIGS. 17A, 18, and 19) opposed to each other is formed in the rear side of an inner peripheral surface 48*a* of the male terminal accommodating chamber 48. The locking projections 52 and 52 constituting a first locking means lock a locking groove 46*e* of the male core 46 which will be described later.

The locking projection 52 comprises an inclined portion 52*a* inclining with respect to the inner peripheral surface 48*a;* a flat portion 52*b* almost parallel with the inner peripheral surface 48*a;* and an engaging portion 52*c* almost perpendicular to the inner peripheral surface 48*a*. These members 52*a*, 52*b*, and 52*c* are continuous with each other and formed in the direction from the front side (X') of the male housing 45 toward the rear side Y' thereof.

A pair of sectionally rectangular core guide grooves 53 and 53 (see FIG. 17B) forming a right angle with each other is formed on the inner peripheral surface 48*a* of the terminal accommodating chamber 48. The core guide grooves 53 and 53 extend along the terminal accommodating chamber 48 in the longitudinal direction thereof as shown. A pair of guide plates 46*f* and 46*f* (see FIGS. 21 and 22) of the male core 46 is inserted into each of the guide grooves 53 and 53.

Similarly to the female connector 23, the annular first rubber ring 34 (see FIGS. 4 and 5) is inserted into the rubber ring accommodating chamber 49.

A sectionally rectangular locking arm inserting portion 54 (see FIGS. 17B and 18) is formed on an upper portion of an outer wall 45*c* (see FIG. 18) disposed at the front side X' of the male housing 45. The locking arm inserting portion 54 is open in only the front side X' and surrounded with right and left side walls 45*d* and 45*d*, an upper wall 45*e*, and a rear wall 45*f*. A locking opening 45*g* (see FIGS. 16 and 18) which engages the locking projection 39*a* (see FIGS. 6, 7, and 9) formed on the locking arm 39 of the female connector 23 is formed on the upper wall 45*e*.

The peripheral surface of the connector engaging portion 47 is thin in the vicinity of the leading end thereof to form an inserting portion 45*h*.

A pair of locking projections 55 and 55 (see FIGS. 15, 16, 17A, and 19), opposed to each other, which engages the locking openings 28*d* of the closing member 28 is formed on the peripheral surface of the male housing 45 at a position disposed in the vicinity of the rear end thereof. The projection 55 is interposed between a pair of guide plates 56 and 56 (see FIGS. 15 and 17A) disposed at the rear end of the male housing 45.

As shown in detail in FIGS. 20 through 23, the male terminal 22 insert-molded in the male core 46 made of insulating resin is made of a conductive material. There is formed, at the front end of the male terminal 22, a connecting portion 22*c* (see FIGS. 20 and 23) comprising forked cylindrical portion 22*b* having a spherical portion 22*a* formed at the leading end thereof. A core wire crimping portion 22*e* (see FIG. 23) is formed in continuation with the connecting portion 22*c* via a flange portion 22*d* (see FIG. 23), and a coating crimping portion 22*f* is formed in continuation with the core wire crimping portion 22*e*.

The male terminal 22 is insert-molded in the male core 46, with the core wire 44*a* and the coating portion 44*b* crimped by the core wire crimping portion 22*f* and the coating crimping portion 22*e*, respectively. The flange portion 22*d* and the connecting portion 22*c* project from a flange-shaped portion 46*a* (see FIGS. 20 and 21), of a large diameter, formed on the front end of the male core 46. A pair of protecting plates 46*b* and 46*b* (see FIGS. 21 and 23) opposed to each other is formed on the flange-shaped portion 46*a* in such a manner that the leading end of the protecting plates 46*b* and 46*b* extends to the vicinity of the center of the connecting portion 22*c* in the longitudinal direction thereof.

The male core 46 comprises a small diameter portion 46*b* in which the core wire crimping portion 22*e* of the male terminal 22 is insert-molded and a large-diameter portion 46*c* in which the coating crimping portion 22*f* thereof is insert-molded. The small diameter portion 46*b* and the large-diameter portion 46*c* are continuously formed and disposed rearward of the flange-shaped portion 46*a*. The outer diameter of the large-diameter portion 46*c* is set so that the large-diameter portion 46*c* is slidable in close contact with the terminal accommodating chamber 48 of the male housing 45.

A sectionally rectangular engaging groove 46*e* (see FIGS. 20, 21, and 23) serving as a second locking means is circumferentially disposed in the vicinity of the rear end surface 46*d* of the large-diameter portion 46*c*. The end surface 46*d* is circumferentially chamfered to form an inclined portion 46*f*.

Guide plates 46*f* and 46*f* (see FIGS. 20, 21, 22A, and 22B) making a right angle with each other and extending from the front side X' of the male core 46 toward the rear side Y' thereof are formed on the peripheral surface thereof.

The closing member 28 mounted on the rear end of the male housing 45 has a construction similar to the closing member 28 of the female connector 23. Therefore, the description of the closing member 28 of the male housing 45 is omitted herein.

In the male connector 24, similarly to the female connector 23, the male core 46 is inserted into the male housing 45 from the front side X' thereof after the rubber ring 34 is inserted into the male housing 45, with the guide plates 46*f* and 46*f* coinciding with each of the core guide grooves 53 and 53. Then, the locking projection 52 is engaged by the locking groove 46*e* of the male core 46 so as to hold the male core 46 in the male housing 45. Thereafter, the closing member 28 is installed on the rear end of the housing 45.

In the male connector 24, similarly to the female connector 23, the end surface 46*d* disposed in the rear end of the male core 46 inserted into the male housing 45 from the front side thereof is locked by the locking wall 50 of the male housing 45. Accordingly, the male terminal 22 can be prevented from being shaken and removed from the male housing 45. The male terminal 22 can be held in the male housing 45 by the engagement between the locking groove 46*e* of the male core 46 and the locking projection 52 of the male housing 45. Accordingly, it is unnecessary to elongate the male housing 45 in the terminal inserting direction thereof unlike the conventional connector in which the terminal is locked by the lance provided in the housing.

In engaging the female connector 23 with the male connector 24, both connectors approach to each other so that the locking elastic arm 39 of the female connector 23 is inserted into the locking arm inserting portion 54 of the male connector 24. At this time, the guide plates 38 and 38 formed on the female connector 23 guide the locking arm inserting portion 54 along the inner surface of the side walls 45*d* and 45*d*, and the inserting portion 45*a* of the male connector 24 disposed at the front end thereof is inserted into the gap 36 of the female connector 23. In this manner, both connectors 23 and 24 can smoothly approached each other.

As a result, the connecting portion 22*c* of the male terminal 22 is inserted into the cylindrical portion 21*a* of the female terminal 21. Consequently, the female terminal 21 and the male terminal 22 are connected to each other. At this time, the locking projection 39*a* formed on the locking elastic arm 39 of the female connector 23 engages the locking opening 45*g* of the male connector 24. Consequently, the connectors 23 and 24 are locked to each other.

At this time, the inserting portion 45*a* of the male connector 24 is inserted into the second rubber ring 37 of the female connector 23, which ensures the connection between the connectors 23 and 24.

Various modification of the connector according to the present invention can be made as follows:

In both male and female connectors, the housing holds the core, made of resin, accommodating the insert-molded terminal, but this construction may be adopted in either the male connector or in the female connector, i.e., one of the terminals may be held by a lance provided in the housing without using the core.

Either the female connector or the male connector may be held in the connector according to the embodiment while the other terminal is disposed in a junction box. That is, the female connector is not necessarily connected with the male connector and the male connector is not necessarily connected with the female connector.

The configuration of the housing and that of the core are not limited to those of the embodiment. For example, the core accommodating the insert-molded terminal is inserted into the accommodating chamber of the housing formed in the direction in which female connector is engaged by the male connector, and locking means formed both in the accommodating chamber and in the core are locked to each other.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A connector assembly comprising first and second connectors being engageable with each other, each connector including:

a housing having an accommodating chamber formed in a connector-engaging direction, each said accommodating chamber having an opening, each opening being open in the connector-engaging direction towards the opening in the other of said accommodating chambers, and first locking means formed in the accommodating chamber; and a core, made of resin and accommodating an insert-molded terminal, said terminal being insert-molded in said core, said core comprising second locking means which engages the first locking means of the accommodating chamber, each said core and insert-molded terminal being inserted together into the respective accommodating chamber through the opening, whereby the core is held in the accommodating chamber.

2. A connector assembly as defined in claim 1, at least said first connector further comprising a locking wall, spaced from the opening and projecting in the accommodating chamber, for locking an end of the core inserted into the accommodating chamber in a direction from the opening.

3. A connector assembly as defined in claim 1, wherein the first locking means comprises a locking projection formed on an inner peripheral surface of the accommodating chamber; and the second locking means comprises a locking groove formed on a peripheral surface of the core.

4. A connector assembly as defined in claim 1, wherein said accommodating chamber of at least one of said first and second connectors includes at least one guide groove, a respective core including at least one guide element for engaging said at least one guide groove.

5. A connector assembly as defined in claim 1, wherein at least one of said first and second connectors includes a locking groove formed at a rear end portion of said core, said locking groove including an inclined surface to enable smooth insertion of said core into said accommodating chamber.

* * * * *